US007246689B2

(12) United States Patent
Huff et al.

(10) Patent No.: US 7,246,689 B2
(45) Date of Patent: Jul. 24, 2007

(54) SELF-POWERED ELEVATOR BUTTON

(75) Inventors: Randolph W. Huff, Hartsdale, NY (US); James A. Nickerson, Spring Valley, CA (US)

(73) Assignee: Thyssen Elevator Capital Corp., Whittier, CA (US)

( * ) Notice: Subject to any disclaimer, the term of this patent is extended or adjusted under 35 U.S.C. 154(b) by 488 days.

(21) Appl. No.: 11/010,099

(22) Filed: Dec. 10, 2004

(65) Prior Publication Data

US 2006/0124400 A1 Jun. 15, 2006

(51) Int. Cl.
*B66B 1/34* (2006.01)

(52) U.S. Cl. ..... 187/395; 187/413

(58) Field of Classification Search ..... 187/391–396, 187/413; 46/26, 28; 340/505, 507, 518, 340/521, 522, 531, 539, 542, 825.69; 342/350; 455/15

See application file for complete search history.

(56) References Cited

U.S. PATENT DOCUMENTS

| | | | | |
|---|---|---|---|---|
| 3,461,422 | A * | 8/1969 | Hansen | 187/390 |
| 6,193,019 | B1 * | 2/2001 | Sirigu et al. | 187/391 |
| 6,467,585 | B1 * | 10/2002 | Gozzo et al. | 187/391 |
| 6,629,583 | B2 * | 10/2003 | Valk et al. | 187/391 |
| 2003/0089558 | A1 * | 5/2003 | Zepke et al. | 187/413 |
| 2005/0284706 | A1 * | 12/2005 | Vecchiotti et al. | 187/313 |

* cited by examiner

*Primary Examiner*—Jonathan Salata
(74) *Attorney, Agent, or Firm*—Frost Brown Todd LLC

(57) ABSTRACT

An elevator hall call device inductively receives an electrical signal from an interlock wiring circuit by means of a coupling device. The elevator hall call device comprises a capacitive device which stores electrical charge based on the electrical signal received from the interlock wiring circuit by means of the coupling device. Hall call circuitry sends and receives signaling information between at least one elevator controller over the interlock wiring circuit, where the hall call circuitry is coupled to the capacitive device for receiving electrical power based on the stored electrical charge in the capacitive device.

25 Claims, 2 Drawing Sheets

SELF-POWERED ELEVATOR BUTTON

FIELD OF THE INVENTION

The present invention is related to elevator hall fixtures, particularly hall call fixtures that utilized alternative power sources for operation. In particular, the present invention is related to hall call fixtures that access electrical power from the interlock wiring of an elevator system.

BACKGROUND OF THE INVENTION

In a complex system environment pertaining to elevators, deriving power and, in particular, trying to conserve and optimize its use is one the many issues that is of paramount importance and interest.

Another important factor to consider is the reduction of signaling and power cable wiring within elevator systems. As the complexity of power and signal wiring increases within an elevator system, so does the installation cost, the installation time, the maintenance cost, the maintenance time, and the overall fault detection overhead.

There are, however, current systems that reduce wiring complexity by utilizing hall fixture devices that operate using rf transceivers. The use of rf as a data or information carrier, therefore, provides a means for reducing wiring complexity. Although these systems purport to reduce wiring complexity, they introduce other challenges, such as, reliability concerns of the rf communication link due to interference, and the provision of electrical power to the rf transceiver devices that are interfaced to the hall fixtures. Therefore, there is a need for providing elevator hall fixtures that reduce the complexity of using discrete wiring. Particularly, there is a need for an elevator system that uses the existing elevator system's wiring infrastructure to provide not only a reliable communication link for the hall fixture devices, but to also furnish a means for providing electrical power to these devices'

It is, therefore, an object of the present invention to provide a hall fixture device that is capable of using the existing wiring infrastructure for signal communications.

It is another object of the present invention to provide a hall fixture device that is capable of extracting power from various sources and resources of electrical power within the existing elevator system infrastructure.

SUMMARY OF THE INVENTION

The present invention provides an elevator signaling device, such as an elevator hall call device, that utilizes the interlock wiring of an elevator system as a means for accessing electrical power for the operability of its electrical circuitry.

An aspect of the systems and methods of the present invention provides an elevator hall call device that inductively receives an electrical signal from an interlock wiring circuit by means of a coupling device. The elevator hall call device comprises a capacitive device for storing an electrical charge associated with the electrical signal that is received from the interlock wiring circuit by means of the coupling device. The hall call device comprises hall call circuitry for sending and receiving signaling information between at least one elevator controller over the interlock wiring circuit, whereby the hall call circuitry is coupled to the capacitive device and receives electrical power based on the stored electrical charge in the capacitive device.

Another aspect of the systems and methods of the present invention provides a method of providing power to an elevator hall call button device which comprises a capacitive device and hall call circuitry. The method comprises the steps of generating an electrical signal along an interlock wiring circuit and inductively coupling the electrical signal from the interlock wiring to the capacitive device. The capacitive device stores the electrical charge associated with the received electrical signal; and provides electrical power to the hall call circuitry based on the stored electrical charge on the capacitive device.

Yet another aspect of the systems and methods of the present invention provides an elevator signaling device in communication with an elevator interlock wiring. The elevator signaling device comprises a hall call device for generating information signals. A coupling device is provided for receiving modulated control signals from the elevator interlock wiring by means of inductive coupling. A transceiver device then generates demodulated control signals from the modulated control signals that are received from the coupling device. The transmitted information signals received from the hall call device are modulated and sending by the transceiver to the coupling device, whereby the modulated information signals are inductively coupled onto the interlock wiring.

DETAILED DESCRIPTION OF THE INVENTION

Figure 1:
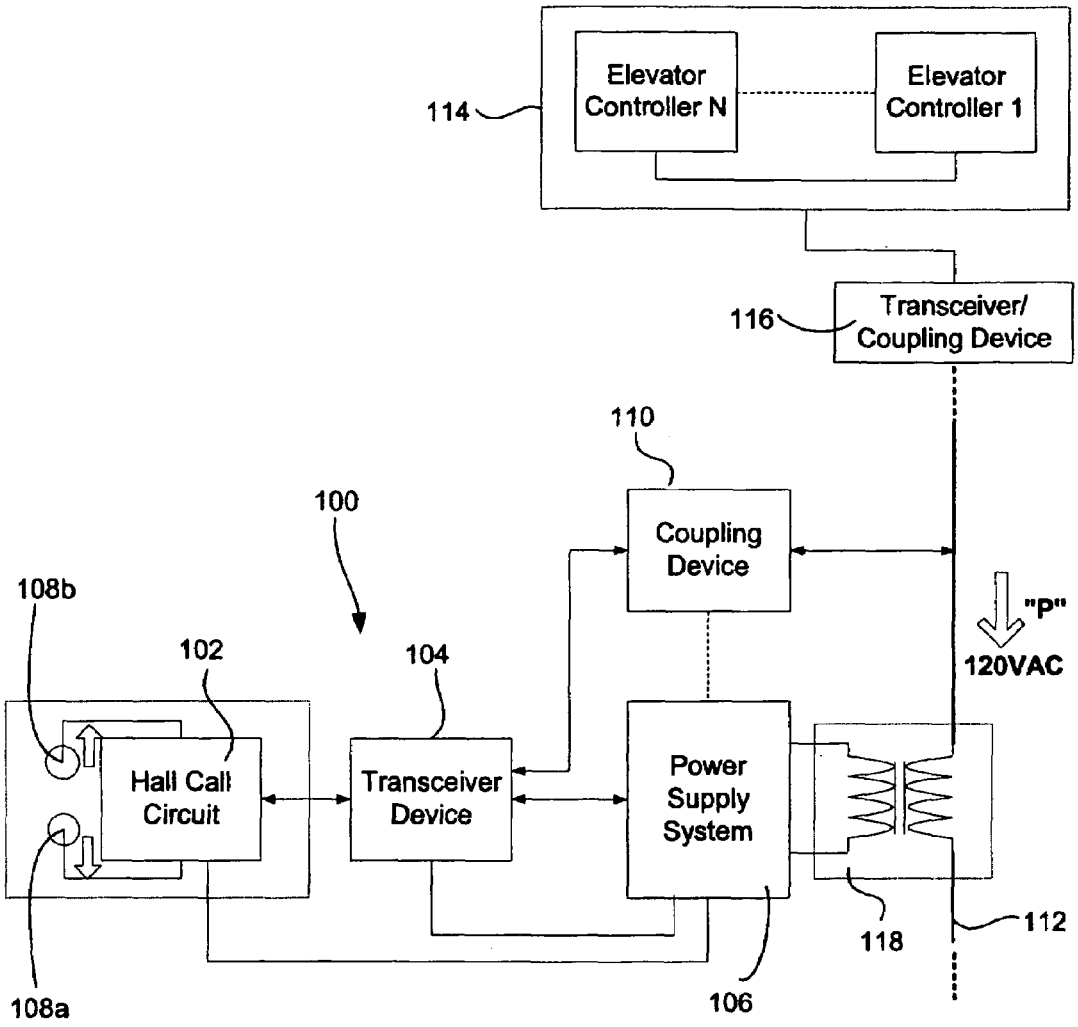
FIG. 1 illustrates an elevator hall call device coupled to an elevator interlock wiring according to an aspect of the present invention.

FIG. 1 illustrates a hall call device 100 according to an aspect of the present invention. Hall call circuit 100 comprises a hall call circuit 102, a transceiver device 104, a power supply system 106, and a coupling device 108. The hall call device 102 also includes up/down buttons 110*a* and 110*b*. Hall call circuit 104 generates electrical signals comprising signaling information which correspond to the actuation of either the up button 110*b* or down button 110*a*. The signaling information generated by the actuation of the up/down buttons 110*a*, 110*b* are received by transceiver 104, where they are processed and modulated onto an rf carrier. The modulated rf carrier signals generated by the transceiver device 104 are received by coupling device 108, where the coupling device 108 inductively couples the modulated rf carrier signals onto elevator interlock wiring 112.

The hall call circuit 102 may format the generated signaling information resulting from the actuation of the up/down buttons 110*a*, 110*b* according to any known method. For example, the generated signaling information may comprise digitized packets having source address information which corresponds to the physical location of the hall call fixture (e.g., $4^{th}$ Floor landing, elevator bank A), a time stamp for indicating the time at which the hall call request was made (i.e., hall call button was actuated), etc. Alternative signaling methods may also be employed by the hall call circuit 102 without departing from the scope of the invention.

The processing, modulation format, and communication protocols adopted by transceiver device 104 may also vary based on different factors, such as, the number of hall fixture devices communicating over the interlock wiring, the length of the interlock wiring, and the cable characteristics (bandwidth) of the interlock wiring. In one embodiment according to the present invention, the coupling device 110 may, for example, comprise an induction coil that is wrapped around the interlock wiring for magnetically inducing the modulated. In another embodiment, the coupling device 110 may include an antenna device placed in proximity to the interlock wiring 112. The electromagnetic radiation associated with the modulated rf carriers emitted from the antenna device are then magnetically induced in the interlock wiring 112, where the modulated rf carriers transmit the signaling information to one or more elevator system controllers 114, and/or a group controller (not shown).

Similarly, modulated control signals generated by the one or more elevator system controllers 114 are coupled onto the interlock wiring using suitable coupling means (e.g., magnetic coupling). The one or more elevator system controllers 114 generate control signals in response to the signaling information received from hall call devices, such as hall call device 100.

For example, when one of the up/down buttons 110*a*, 110*b* is actuated, the signaling information comprises a hall call signal, which requests that an elevator to be dispatched to the corresponding floor from which the hall call originated from. Once an elevator controller receives and processes this hall call signal, it generates a control signal comprising a hall call acknowledgment signal, which among other things, illuminates the display (not shown) on the up/down buttons 110*a*, 110*b*. The hall call acknowledgment signal generated by the controller is modulated onto an rf carrier and coupled onto the interlock wiring 112 by transceiver/coupling device 116. The coupling adopted by the transceiver/coupling device 116 may include an induction coil or antenna device for magnetic induction of the modulated rf carrier onto the interlock wiring 112. Other induction or coupling techniques may be used to couple the signals onto the interlock wiring. Although rf signals and magnetic induction devices (e.g., antenna, coils, etc.) have been described in relation to coupling devices 110 and 116, other coupling or signal inducing techniques may be employed.

Once the modulated rf signals comprising the control signals are transmitted along the interlock wiring, coupling device 110 receives the control signals, which are then sent to transceiver 104 for demodulation. The demodulated control signals are sent to the hall call circuit 102 where they are decoded. Based on the control function that is extracted from the decoded control signals, a particular signaling operation, such as, for example, illuminating the up/down button display, changing the hall call operating mode, etc, is executed at the hall call device 100.

Power supply system 106 provides electrical power to the hall call device 100. Therefore, power is provided to the hall call circuit 102, the transceiver device 104, and the coupling device 110 (if required).

Coupling device may not require any power if it a passive device such as an induction coil. However, if the coupling device 110 comprises any pre-amplification or post signal detection processing, power may be provided to the coupling device 110 via power supply system 106. Power supply system 106 extracts electrical power the 120V AC signal flowing in the interlock wiring 112, as illustrated in FIG. 1.

Figure 2:
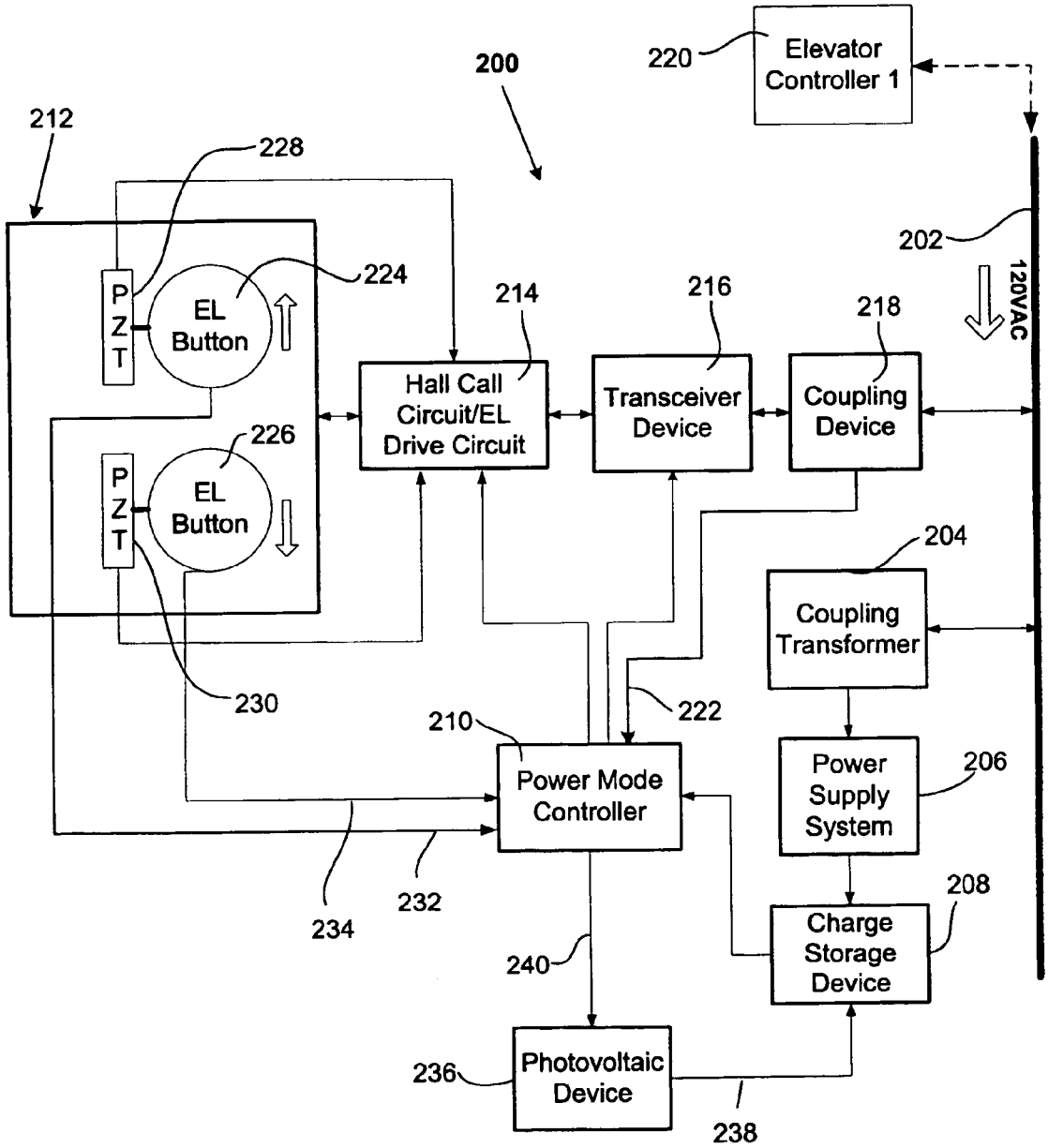
FIG. 2 illustrates the electrical power resources of the hall call device illustrated in FIG. 1 in accordance with an aspect of the present invention.

FIG. 2 illustrates the electrical power resources of the hall call device 100 illustrated in FIG. 1. As shown in FIG. 2, the 120V AC signal flowing in the interlock wiring 202 is coupled via coupling transformer 204 to power supply system 206. Power supply 206 may comprise circuitry for generating DC regulated electrical power from the 120V AC input signal that is inductively coupled from the coupling transformer 118. Once the AC signal is rectified and regulated to a desired DC voltage, it is applied to an electrical charge storage device 208. The electrical charge storage device may comprise an ultra-high capacitance device, such as an Aerogel Supercapacitor, supplied by PowerStor®, a business unit of Cooper Electronics Limited, headquartered in Boynton Beach, Fla.

The charge storage device 208 stores electrical charge associated with the regulated DC voltage provided by power supply 206, where the stored electrical charge maintained on the charge storage device 208 provides electrical power to all or most of the components of hall call device 200 via a power mode controller 210. As illustrated, the power mode controller 210 distributes electrical power to hall call up/down buttons 212, hall call circuit/EL circuit drive 214, transceiver device 216, and coupling device 218 (optional power). Also, during instances when the 120V AC signal does not flow in the interlock wiring 202 due to an elevator being in the open position, or an elevator being out of service for maintenance, the charge storage device 208 provides electrical power to hall call device 200 by means of the stored electrical charge previously derived from the interlock lock wiring 202.

The power mode controller 210 within hall call device 200 may store the operating mode of the elevator hall call device 200. For example, the hall call device 200 may be in VIP mode, where any elevator car dispatched to the floor in which the hall call device 200 is located will only be permitted to travel to a designated floor (e.g., a penthouse) without making any stops in between. Power mode controller 210 also includes a "sleep mode" for conserving electrical power within the hall call device 200, particularly when the device has been idle for a predetermined period of time. If the hall call device 200 has been idle, power mode controller 210 may disconnect electrical power between the charge storage device and other components of the hall call device 200, such as, up/down buttons 212 (optional power), hall call circuit/EL drive circuit 214, transceiver 216, and coupling device 218 (optional power). This ensures an increase in power conservation within the charge storage device 208 (e.g., Aerogel Supercapacitor).

If the coupling device 218 is a passive device such as a coil or antenna, and does not include any active circuitry requiring power, then the power mode controller 210 does not need to control the provision of power to this device 218. Similarly, if the hall call buttons 212 are self powering (e.g., solar powered), likewise, it does not require power from the power mode controller 210. Although power mode controller 210 is illustrated as a separate device within hall call device 200, it may be integrated within another device, such as, for example, charge storage device 208, or power supply 206.

Hall call device 200 may recover (i.e., power up) from "sleep mode" at the instant that it either receives a rf modulated control signal transmitted from the elevator controller 220 (FIG. 1), or when one of the hall call buttons 212 are actuated by a potential passenger. When the elevator controller 220 generates and transmits an rf modulated control signal over the interlock wiring 202 to the coupling device 218, the modulated control signal is detected at input 222 to the power mode controller 210. Upon detection of this signal, the power mode controller 210 re-establishes electrical power to the various devices within the hall call device 200 (e.g., transceiver device 216, hall call circuit/EL drive circuit 214).

Hall call up/down buttons 212 comprises an up button 224, a down button 226, up button piezo electric module 228, and down button piezo electric module 230. As the up button 224 is actuated, the piezo electric module 228 generates signaling information based on a mechanical force exerted on the piezo electric module 228 by the button 226. The signaling information is received and processed by the hall call circuit/EL drive circuit 214, where the generated signaling information may be converted into digitized packets that include source address information corresponding to the physical location of the hall call fixture (e.g., $4^{th}$ Floor landing, elevator bank A), a time stamp for indicating the time at which the hall call request was made (i.e., button 224 was actuated), "operating mode" information related to the operation of the elevator system (e.g., VIP mode, Code Blue mode, etc.), and other information fields that provide functionality and utility within the elevator environment. Based on the communications protocol and signal modulation format adopted by the system, the converted signaling information is modulated onto an rf carrier frequency at the transceiver device 216. The modulated signaling information generated at the transceiver 216 is then inductively coupled onto the interlock wiring 202 via coupling device 218.

Similarly, as the down button 226 is actuated, the piezo electric module 230 generates signaling information based on the mechanical force exerted on piezo electric module 230. The signaling information is received and processed by the hall call circuit/EL drive circuit 214, where the generated signaling information may be converted into digitized packets that include source address information corresponding to the physical location of the hall call fixture (e.g., $4^{th}$ Floor landing, elevator bank A), a time stamp for indicating the time at which the hall call request was made (i.e., button 226 was actuated), "operating mode" information related to the operation of the elevator system (e.g., VIP mode, Code Blue mode, etc.), and other information fields that provide functionality and utility within the elevator environment. Based on the communications protocol and signal modulation format adopted by the system, the converted signaling information is then modulated onto an rf carrier frequency at transceiver device 216. The modulated signaling information generated at the transceiver 216 is then inductively coupled onto the interlock wiring 202 via coupling device 218.

When the elevator controller 220 generates and transmits an rf modulated control signal over the interlock wiring 202 to the coupling device 218, the modulated control signal is detected at input 222 to the power mode controller 210. Upon detection of this signal, if the hall call device 200 was in "sleep mode," the power mode controller 210 re-establishes electrical power to the various devices (e.g., transceiver device 216, hall call circuit/EL drive circuit 214) within the hall call device 200. Once power is provided via the power controller 210, the transceiver 216 and hall call circuit/EL drive circuit 214 process the modulated control signal received by the coupling device 218. Transceiver 216 demodulates the modulated control signals.

The demodulated control signal is then received by hall call circuit/EL drive circuit 214, where it is processed. By processing the control signal, the hall call circuit/EL drive circuit 214 generates a command or appropriate signal corresponding to the issued control signal which originated from the elevator controller 220. For example, if the control signal is an "acknowledgement signal" that is generated in response to a "hall call request signal," the electroluminescent drive circuit within the hall call circuit/EL drive circuit 214 generates a display signal for illuminating the appropriate electroluminescent display associated with the hall call button (i.e., 224 or 226) that was actuated.

Upon actuation of the up button 224, an actuation sensing signal may be generated and received by input 232 of the power mode controller 210. The actuation signal may be generated by any known sensing means for detecting that the button 224 has being or about to be actuated. Similarly, by actuating the down button 226, an actuation sensing signal may be generated and received by input 234 of the power mode controller 210. This actuation signal may also be generated by any known sensing means for detecting that the up button 226 has been being or about to be actuated.

Although up and down button piezo electric modules 228 and 230 provide a self powered mechanism for generating hall call signaling information associated with a hall call request, it may be possible to directly provide electrical power to the hall call up/down buttons 212 via the charge storage device 208 and power mode controller 210. In this embodiment, up and down button piezo electric modules 228 and 230 may be omitted.

As previously discussed, the hall call device 200 is powered by electrical charge stored in charge storage device 208, whereby the electrical charge is inductively, or otherwise, coupled from the 120V AC electrical power signal flowing in interlock circuit 202. Hall call device 200 also comprises a photovoltaic device 236, which serves as an additional source of electrical power for charging charge storage device 208. Photovoltaic device 236 receives light (either natural or artificially generated photons of light) and converts it to electrical current. Depending on the location of the hall call device 200, photovoltaic device 236 generates electrical current from light that is generated in the vicinity of hall call device 200 and photovoltaic device 236 (e.g., hall landing lights, light coming through a window, etc.).

Under the control of the power mode controller 210, the photovoltaic device 236 may provide electrical charge to the charge storage device 208 on occasions when the charge storage device 208 is not being charged from the 120V AC electrical power signal coupled from the interlock wiring 202. This may occur due to an elevator door being open, which creates a break in the interlock wiring 202 circuit. Alternatively, an elevator may be out of service for maintenance, which also creates a condition where no electrical current (i.e., 120V AC) flows in the interlock wiring 202. Alternatively, the photovoltaic device 236 may provide electrical charge to the charge storage device 208 simultaneously as the charge storage device 208 is charged from the 120V AC electrical power signal coupled from the interlock wiring 202. The photovoltaic device output, indicated by 238, is enabled or disabled by power mode controller 210 via control input 240.

The embodiments shown in FIGS. 1 and 2 illustrate up and down buttons 224 and 226. It will be appreciate, however, that the hall call devices illustrated and described herein, may include a single or a plurality of buttons without departing from the spirit and scope of the present invention. For example, a hall call device on the top floor or ground floor of a building may only require a single button. Similarly, a hall call device may comprise a plurality of buttons and sensors (not shown) for providing a multitude of signaling information associated with a multitude of elevator functionality.

In addition to the embodiments of the aspects of the present invention described above, those of skill in the art will be able to arrive at a variety of other arrangements and steps which, if not explicitly described in this document, nevertheless embody the principles of the invention and fall within the scope of the appended claims. For example, the ordering of method steps is not necessarily fixed, but may be capable of being modified without departing from the scope and spirit of the present invention.

What is claimed is:

1. An elevator hall call device inductively receiving an electrical signal from an interlock wiring circuit by means of a coupling device, the elevator hall call device comprising:

an electrical charge storage device for storing electrical charge associated with the electrical signal received from the interlock wiring circuit by means of the coupling device; and hall call circuitry for sending and receiving signaling information between at least one elevator controller over the interlock wiring circuit, the hall call circuitry coupled to the electrical charge storage device for receiving electrical power based on the stored electrical charge on the electrical charge storage device.

2. The device according to claim 1, wherein the hall call circuitry comprises:

a hall call circuit for generating hall call signals; and a transceiver device for receiving and transmitting the hall call signals to the at least one elevator controller for processing.

3. The device according to claim 2, wherein the hall call circuit further comprises at least one push button for generating the hall call signals.

4. The device according to claim 3, wherein the at least one push button comprises an electroluminescent display, wherein the electroluminescent display is activated when the at least one push button is actuated.

5. The device according to claim 3, wherein the hall call circuit further comprises a piezo-electric device coupled to the at least one push button for generating an electrical indication signal upon actuation of the at least one push button.

6. The device according to claim 1, wherein the electrical signal is a 120 V AC signal.

7. The device according to claim 1, wherein the coupling means is a coupling transformer.

8. The device according to claim 1, wherein the hall call circuitry further comprises a photovoltaic device for providing a secondary electrical charge to the electrical charge storage device, wherein the secondary electrical charge is stored in the electrical charge storage device.

9. The device according to claim 8, wherein the hall call circuitry further comprises a power controller for controlling the provision of the secondary electrical charge to the electrical charge storage device when no electrical charge associated with the electrical signal received from the interlock wiring circuit is received by the electrical charge storage device.

10. The device according to claim 8, wherein the hall call circuitry further comprises a power controller for controlling the provision of simultaneously providing the secondary electrical charge and the electrical charge associated with the electrical signal received from the interlock wiring circuit to the electrical charge storage device.

11. The device according to claim 1, wherein the electrical charge storage device comprises a capacitance device, wherein the capacitance device is an aerogel capacitor.

12. A method of providing power to an elevator hall call button device comprising an electrical charge storage device and hall call circuitry, the method comprising the steps of:

generating an electrical signal along an interlock wiring circuit;

inductively coupling the electrical signal from the interlock wiring to the electrical charge storage device, the electrical charge storage device storing an electrical charge associated with the received electrical signal; and providing electrical power to the hall call circuitry based on the stored electrical charge on the electrical charge storage device.

13. The method according to claim 12, further comprising providing a secondary power source for storing an additional electrical charge on the electrical charge storage device.

14. The method according to claim 13, wherein the secondary power source comprises a photovoltaic device for charging the electrical charge storage device during instances when the electrical charge is not inductively coupled from the interlock wiring to the electrical charge storage device.

15. The method according to claim 13, wherein the secondary power source comprises a photovoltaic device for charging the electrical charge storage device simultaneously during instances when the electrical charge is inductively coupled from the interlock wiring to the electrical charge storage device.

16. The method according to claim 11, further comprising generating a hall call signal by actuating at least one hall call button associated with the hall call circuitry.

17. The method according to claim 11, wherein actuating the at least one hall call button activates a piezo-electric device that generates the hall call signal.

18. An elevator signaling device in communication with an elevator interlock wiring, the elevator signaling device comprising:

a hall call device for generating signaling information;

a coupling device for receiving modulated control signals from the elevator interlock wiring by means of inductive coupling; and a transceiver device for generating demodulated control signals from the modulated control signals received from the coupling device, and modulating the generated signaling information received from the hall call device and sending the modulated signaling information to the coupling device, whereby the modulated signaling information is inductively coupled onto the interlock wiring.

19. The device according to claim 18, wherein the hall call device comprises an electroluminescent display device and at least one hall call button, the electroluminescent display device receiving the demodulated control signals from the transceiver signal and illuminating the at least one hall call button.

20. The device according to claim 18, further comprising an electrical charge storage device for receiving an electrical signal from the interlock wiring, wherein the electrical signal flows within the interlock wiring.

21. The device according to claim 20, wherein the electrical charge storage device comprises a capacitor device for storing electrical charge based on the received electrical signal from the interlock wiring.

22. The device according to claim 21, wherein the stored electrical charge provides electrical power for the operability of the transceiver device.

23. The device according to claim 21, wherein the stored electrical charge provides electrical power for the operability of the hall call device.

24. The device according to claim 18, wherein the coupling device comprises an induction coil.

25. The device according to claim 18, wherein the coupling device comprises an antenna.

* * * * *

UNITED STATES PATENT AND TRADEMARK OFFICE
Certificate

Patent No. 7,246,689 B2 Patented: July 24, 2007

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Randolph W. Huff, Hartsdale, NY (US); James A. Nickerson, Spring Valley, CA (US); Rory Smith, El Cajon, CA (US); and San Aranggi Soemardjan, El Cajon, CA (US).

Signed and Sealed this Twenty-fourth Day of November 2009.

WALTER BENSON
*Supervisory Patent Examiner*
Art Unit 2837